United States Patent [19]

Sprague

[11] Patent Number: 4,765,624

[45] Date of Patent: Aug. 23, 1988

[54] GOLF TRAINING APPARATUS

[76] Inventor: Derek A. Sprague, P.O. Box 3597, James Madison University, Harrisonburg, Va. 22807

[21] Appl. No.: 23,254

[22] Filed: Mar. 9, 1987

[51] Int. Cl.[4] ..... A63B 69/36

[52] U.S. Cl. ..... 273/183 E; 273/186 C; 273/192

[58] Field of Search ..... 273/191 R, 192, 186 R, 273/186 C, 191 A, 191 B, 183 A, 183 E, 190 R

[56] References Cited

U.S. PATENT DOCUMENTS

| | | | |
|---|---|---|---|
| 2,754,125 | 7/1956 | Engler | 273/192 |
| 3,246,898 | 4/1966 | Shoaf | 273/186 C |
| 3,953,033 | 4/1976 | Kelly et al. | 273/183 E |
| 4,082,287 | 4/1978 | Berkey | 273/186 C |

*Primary Examiner*—George J. Marlo

*Attorney, Agent, or Firm*—James Creighton Wray

[57] ABSTRACT

A training apparatus is designed to improve a golfer's putting ability by training the golfer's eyes not to follow the head of the putter on the back swing during putting. The training apparatus has an opaque cover which is connected to a vertical support which is connected to a base for placement on a putting surface adjacent a golf ball. The opaque cover has a cut-away portion to be positioned above the golf ball so as to allow the golfer to view the golf ball. The head of the putter is hidden by the opaque cover which is spaced above the putting surface. To practice, a golf ball is placed beneath the cut-away portion so that the ball is visible from above. The putter head is placed behind the golf ball and is obscured from view by the cover. Preferably, the cover is approximately six inches in length behind the cut-away portion. The various parts of the apparatus are uniquely assembled by interfitting tongue and groove portions along edges of the parts. The apparatus is easy to assemble, disassemble and use.

20 Claims, 1 Drawing Sheet

GOLF TRAINING APPARATUS

BACKGROUND OF THE INVENTION

The present invention generally relates to the sport of golf and more particularly to an apparatus for improving a golfer's putting ability.

Golfers have a natural tendency to follow the putter head back during the back swing of the putting stroke and by having his or her eyes leave the ball, accuracy of the putt is diminished. By having the eyes follow the putter head, the golfer loses concentration and "feel" for the putt.

Putting devices are found in Class 237, Amusement Devices, Games, subclasses 191, 192, 163, 186, 183, 193 and 194.

One U.S. patent, U.S. Pat. No. 4,082,287, typifies the complicated and impractical approaches others have taken in an effort to provide putting improvement. The reference teaches a transparent overhang portion which provides a sight which is aligned with the putter head. However, the apparatus does nothing to prevent the golfer's eyes from following the putter head in the back swing of the putting stroke.

SUMMARY OF THE INVENTION

The present invention provides an apparatus which obscures the putter head from view while a golfer practices putting. Basically, a solid piece of plastic is cantilevered over a golf ball and putter head. The solid piece of plastic acts as a cover and is provided with a cut-away portion at a leading edge so that the golf ball is visible to the golfer in his or her putting stance. The cut-away portion is at the leading edge, meaning that the cut-away portion faces the direction of the putt. One of the features of the present invention is that the solid piece of plastic can be disassembled, inverted and reassembled to suit either a left or right-handed golfer.

By obstructing the golfer's view of the putter head, the golfer is encouraged to have better concentration and develops a more solid stroke based on "feel" instead of visualizing the putter head during the back swing of the putting stroke.

Preferably, the cover is approximately six inches in length behind the cut-away portion. The six inch solid piece cantilevered over the putter head, which the putter head runs under, is critical because after six inches in the back swing one would have to move his or her head to follow the putter.

An object of the invention is to keep a golfer's head still along with his or her eyes focussed on the ball.

Another object of the invention is to provide a three-piece easy-to-assemble, snap-together training device which is easy to carry, handle and store.

An object of the invention is to provide a training apparatus used in the sport of golf for the purpose of improving a golfer's putting, comprising, visual obstruction means, supported above a putting surface by support means connected to the visual obstruction means, wherein the visual obstruction means comprises an opaque substantially horizontal planar member having a cut-away portion located at a forward outer corner of the planar member under which a golf ball is placed prior to putting, wherein during putting the putter head is substantially obscured from the golfer's view by the horizontal planar member rearward of the cut-away portion.

Preferably the support means comprises a substantially horizontal planar base member, and a vertical support member connected to the base member and to the opaque planar member, and the vertical support forms a right angle with the opaque member and the base member.

The preferred embodiment has means for connecting the vertical support to the base member and the opaque planar member.

The connecting means may be tongue and groove connecting means.

Preferably, the base member is provided with an upwardly opening groove and the opaque planar member is provided with a downwardly opening groove, and the vertical support is fitted into the grooves.

In one embodiment, the opaque planar member is provided with a second upwardly opening groove adjacent the downwardly opening groove, wherein the cut-away portion is disposed at a left-hand outer corner of the opaque planar member when viewed from above when the vertical support is fitted into the downwardly opening groove, and wherein the position of the cut-away portion is reversible for left-handed golfers by inverting the opaque planar member and fitting the vertical support into the second groove.

Another object of the invention is to provide means for stabilizing the base member with respect to the putting surface. The stabilizing means may include golf tees which are pressed through holes provided in the base member and anchored to the putting surface.

The stabilizing means may also include a weight of sufficient quantity to prevent tilting of the opaque planar member under its own weight.

In one embodiment, a raised rim extends upwardly from edges of the base member.

Another embodiment includes indentations in an upper surface of the base member for retaining golf balls.

Preferably, the opaque planar member is approximately six inches in length behind the cut-away portion.

The the base member, vertical support and opaque planar member are preferably made of thermoplastic material, and the grooves are formed by heating and bending edge portions of the base member and the opaque planar member.

The vertical support is preferably planar and rectangular and has a length corresponding to a length of the grooves and a width sufficient to space the opaque planar member above the putting surface.

Another object is to provide a compact, portable golf training apparatus comprising three interconnectable parts, including a thin, flat base having a groove formed along one longitudinal edge, a thin, flat vertical support having one longitudinal edge insertable into the base groove, and a thin, flat non-transparent cover having a first groove formed along one longitudinal edge, the cover groove receiving the opposite longitudinal edge of the vertical support, the cover substantially extending in a direction opposite the base and having a cut-away portion provided on an outer corner of the cover under which a golf ball is to be placed for practice putting.

Preferably, the cover is provided with a second oppositely extending groove adjacent the first groove, wherein the cover is invertable to change the location of the cut-away portion from one side corner to an opposite side corner to accommodate both left and right handed putting strokes.

The three parts are preferably made of thermoplastic material and wherein the grooves are formed by heating and bending edge portions of the base and cover.

DETAILED DESCRIPTION OF THE INVENTION

Figure 1:
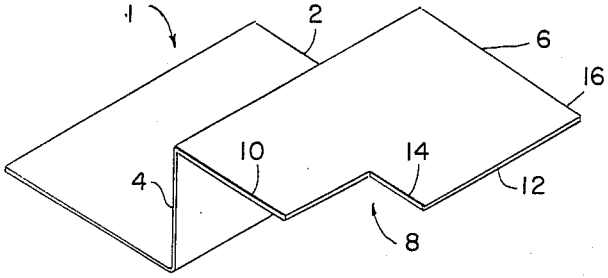
FIG. 1 is a perspective view of a preferred embodiment of the invention.

Referring now to FIGS. 1–4, the practice apparatus of the present invention is generally referred to by the numeral 1. The apparatus has a base 2, a vertical support 4 connected to the base, and a cover 6 connected to the vertical support.

The cover 6 must be opaque and is provided with a cut-away portion 8 beneath which the golf ball is placed prior to practice putting. The cut-away portion 8 must be provided at the leasing edge 10 and the outer edge 12 of the cover 6. The leading edge is defined as the edge facing the direction of the putt. One of the salient features of the present invention is that the cover 6 is invertable so that the apparatus can be used for right and left-handed putting strokes.

In the preferred embodiment, the cover 6 has a length of approximately six inches from edge 14 of the cut-away portion to edge 16 of the cover which is opposite the leading edge 10.

Figure 3:
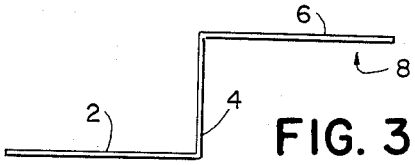
FIG. 3 is a side view of the embodiment of FIG. 1.

While it would be possible to make the device of FIG. 1 in a one-piece molded construction as shown in FIG. 3, a one-piece molded construction would have several disadvantages, the most important of which is that the device could not be easily carried in a golf bag to a practice green.

One of the primary features of the present invention, therefore, is the provision of means for interconnecting the various components of the apparatus. The connecting means provided herein allow for the inversion of the cover 6 to accommodate both left and right-handed golfers.

Figure 2:
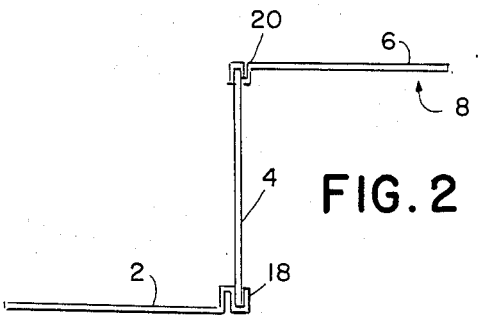
FIG. 2 is a side view of another embodiment having components similar to the embodiment of FIG. 1.

FIG. 2 shows an embodiment of the invention in which base 2 and cover 6 are provided with grooves along edge portions 18, 20. Vertical support 4 would have end portions insertable into the grooves to provide an interference fit in which the various elements can be assembled and disassembled with ease. Edge portion 20 of cover 6 is provided with two grooves, each opening in opposite directions, so that the cover 6 can be inverted and reassembled. After inversion, the leasing edge and cut-away portion are disposed on opposite sides of the cover from where they were prior to inversion.

Figure 4:
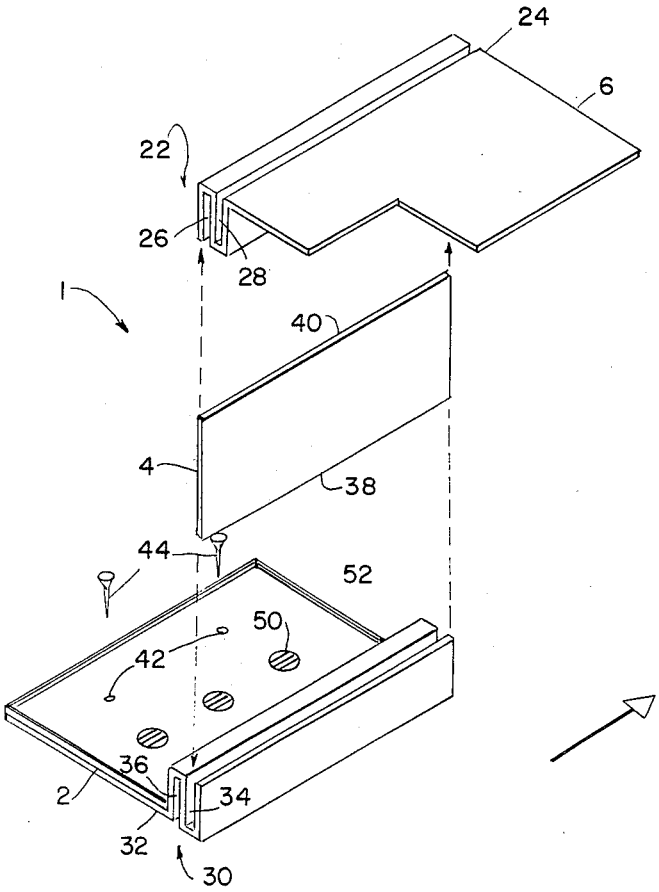
FIG. 4 is an exploded view of a preferred embodiment of the invention.

The preferred means for assembling the various components is shown in the exploded view of FIG. 4. As will be explained, grooved edge portions have been exaggerated in the drawing for illustration purposes.

In the preferred embodiment, the three primary components, the cover, vertical support and base, are all made of thermoplastic material. The material comes in sheet form and can be made as thin as possible, so long as rigidity of the sheets can be maintained.

Thermoplastic material is preferred since edge portions of the base 2 and cover 6 can be heated and then bent in an S-shaped bend, whereupon after cooling, the material rigidifies and forms two grooves extending in opposite directions. The S-shaped bend 22 formed along edge portion 24 of cover 6 defines a first groove 26 and a second groove 28. S-shaped bend 30 provided along edge portion 32 of base 2 is similarly provided with a first groove 34 and a second groove 36. Groove 36 is not active in interconnecting the various parts. However, the S-shaped bend is necessary to form groove 34 which slideably receives a longitudinal edge 38 of the vertical support 4.

For a right-handed golfer, the apparatus would be assembled as shown in the exploded view of FIG. 4 with longitudinal edge 38 received in groove 34 and longitudinal edge 40 received in groove 26.

To convert the apparatus for use with a left-handed putting stroke, the longitudinal edge 40 is separated from groove 26 and the cover 6 is inverted so that longitudinal edge 40 is fitted into groove 28.

In preferred embodiments of the invention, the apparatus 1 is provided with means to stabilize the base 2 to prevent tilting of the cover 6 downwardly under its own weight. Preferably, the base 2 is provided with holes 42 which receive golf tees 44 which anchor the base 2 to the putting surface. It can be appreciated that the putting surface referred to above is a putting green. This allows the golfer to assemble the apparatus on the putting green and anchor the apparatus to the putting green with conventional golf tees.

Figure 5:
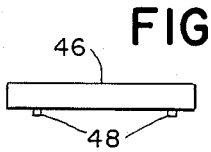
FIG. 5 is a side view of a weight attachment for the embodiment of FIG. 4.

For indoor applications, the base 2 may be weighted down with any available weighting means such as books, shoes, etc. Preferably, the apparatus would include a weight 46 shown in FIG. 5.

Weight 46 is provided with pegs 48 which are spaced to coincide with the spacing of holes 42 in the base 2. The pegs 48 provide means for positioning and holding the weight in a desired location on a rearward edge portion of the base 2.

In another embodiment of the invention, indentations 50 may be provided in an upper surface of the base 2 for the purpose of holding golf balls. The indentations are of a depth sufficient to prevent golf balls from freely rolling on the upper surface. In lieu of indentations 50, or in addition thereto, a raised rim 52 may be provided along edge portions of the base 2 to act as a retaining wall for the purpose of retaining golf balls, tees, etc.

Figure 6:
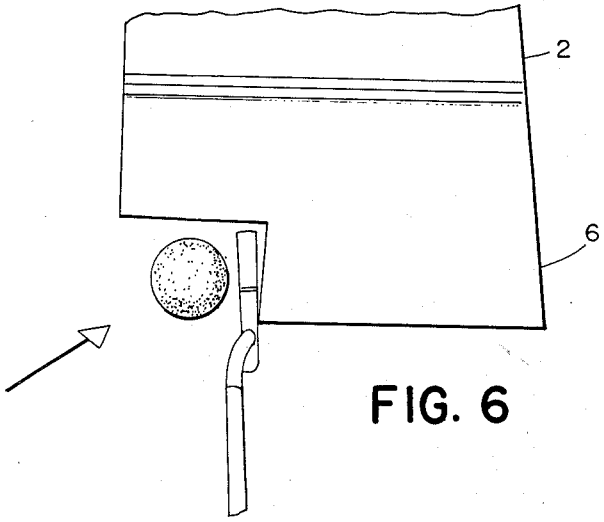
FIG. 6 is a top view of a preferred embodiment of the invention, viewed from a right-handed putting stance.
Figure 7:
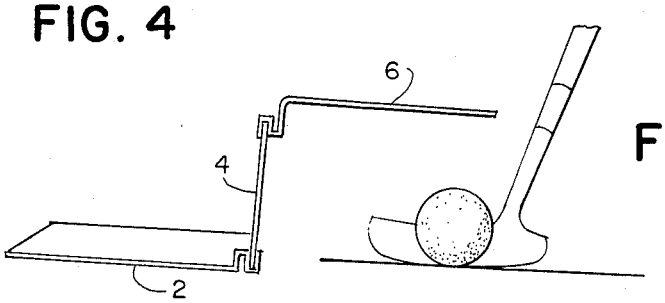
FIG. 7 is a side view of the embodiment of FIG. 6.

FIGS. 6 and 7 show in more detail how the device operates to train the golfer. In FIG. 6, a golf ball is shown properly positioned under the cut-out portion of the cover. Prior to initiating the putting stroke, the head of a putter is visible behind the golf ball. In the normal back swing, the putter head is essentially obscured under the cover, deliberately, so that the golfer is trained not to follow the putter head with his or her eyes. It should be appreciated that the apparatus is most suitable as a training device for putts not having an excessive length. Obviously, a putt of 50 feet would require more than a six inch back swing. Most damage done by following the putter head visually is in the putt range of less than 25 feet. Therefore, the present invention is most applicable for putts in the short to medium range. This is the area where most golf strokes are lost in a round.

FIG. 7 shows more detail of the grooves formed by bending otherwise planar sheets of plastic. The plastic shown in FIG. 7 is thin, and is preferably in the range of 1 to 2 mm in thickness. Thicker plastic material would be used in the embodiments that require grooves formed in the planar surfaces as shown in FIG. 2. The edge portions shown in FIG. 4 may be bent, or they may be premolded in shape. Premolded edges would function the same way as the "bent" edges. However, the premolded edges would have a better appearance by using linear surfaces instead of the curvilinear surfaces provided in the bending process.

When preformed edges are to be used, the various parts may be made of any suitable plastic, not necessarily thermoplastic. Plastics materials are preferred, although the various components could easily be made of metal stampings from sheet metal. In one variation of the invention, the base could be fabricated of relatively heavy material while the vertical support and cover could be made of relatively lighter material, thereby alleviating the necessity for stabilizing means. In such a situation, the base may be made of metal and the vertical support and cover may be made of plastic material. The only requirement is that the grooves are formed to properly interfit with the vertical support.

I claim:

1. A training apparatus used in the sport of golf for the purpose of improving a golfer's putting, comprising,
   visual obstruction means, supported above a putting surface by support means connected to the visual obstruction means,
   wherein the visual obstruction means comprises an opaque substantially horizontal planar, rectangular member having a cut-away portion located at a forward outer corner of the planar member under which a golf ball is placed prior to putting, wherein during putting the putter head is substantially obscured from the golfer's view by the horizontal planar member rearward of the cut-away portion.

2. The apparatus of claim 1 wherein the support means comprises a substantially horizontal planar base member, and a vertical support member connected to the base member and to the opaque planar member.

3. The apparatus of claim 2 wherein the vertical support forms a right angle with the opaque member and the base member.

4. The apparatus of claim 3 further comprising means for connecting the vertical support to the base member and the opaque planar member.

5. The apparatus of claim 4 wherein the connecting means comprise tongue and groove connecting means.

6. The apparatus of claim 5 wherein the base member is provided with an upwardly opening groove and the opaque planar member is provided with a downwardly opening groove, and wherein the vertical support is fitted into the grooves.

7. The apparatus of claim 6 wherein the opaque planar member is provided with a second upwardly opening groove adjacent the downwardly opening groove, wherein the cut-away portion is disposed at a left-hand outer corner of the opaque planar member when viewed from above when the vertical support is fitted into the downwardly opening groove, and wherein the position of the cut-away portion is reversible for left-handed golfers by inverting the opaque planar member and fitting the vertical support into the second groove.

8. The apparatus of claim 7 wherein the vertical support is planar and rectangular and has a length corresponding to a length of the grooves and a width sufficient to space the opaque planar member above the putting surface.

9. The apparatus of claim 6 wherein the base member, vertical support and opaque planar member are made of thermoplastic material.

10. The apparatus of claim 2 further comprising means for stabilizing the base member with respect to the putting surface.

11. The apparatus of claim 10 wherein the stabilizing means comprises golf tees which are pressed through holes provided in the base member and anchored to the putting surface.

12. The apparatus of claim 10 wherein the stabilizing means comprises a weight of sufficient quantity to prevent tilting of the opaque planar member under its own weight.

13. The apparatus of claim 10 further comprising a raised rim extending upwardly from edges of the base member.

14. The apparatus of claim 10 further comprising indentations in an upper surface of the base member for retaining golf balls.

15. The apparatus of claim 2 wherein the opaque planar member is approximately six inches in length from the cut-away portion.

16. A compact, portable golf training apparatus comprising three interconnectable parts, including
   a thin, flat base having a groove formed along one longitudinal edge,
   a thin, flat vertical support having one longitudinal edge insertable into the base groove, and
   a thin, flat, rectangular non-transparent cover having a first groove formed along one longitudinal edge, the cover groove receiving the opposite longitudinal edge of the vertical support, the cover substantially extending in a direction opposite the base and having a cut-away portion provided on an outer corner of the cover under which a golf ball is to be placed for practice putting.

17. The apparatus of claim 16 wherein the cover is provided with a second oppositely extending groove adjacent the first groove, wherein the cover is invertable to change the location of the cut-away portion from one side corner to an opposite side corner to accommodate both left and right-handed putting strokes.

18. The apparatus of claim 17 wherein the three parts are made of thermoplastic material.

19. The apparatus of claim 17 further comprising means for stabilizing the base with respect to the putting surface.

20. The apparatus of claim 19 wherein the stabilizing means comprise golf tees insertable into holes provided in the base to anchor the base to the putting surface.

* * * * *